US006040536A

United States Patent [19]

Miller et al.

[11] Patent Number: 6,040,536

[45] Date of Patent: Mar. 21, 2000

[54] PRESSURE RESPONSIVE SWITCH AND METHOD OF MAKING SAME

[75] Inventors: Bearge Miller; Norman K. Miller, both of Glen Mills; Gevork Sarkisian, Philadelphia; Karen Sarkissian, Philadelphia; Anatoly Galperin, Philadelphia, all of Pa.

[73] Assignee: Miller Edge, Inc., Jennersville, Pa.

[21] Appl. No.: 09/012,993

[22] Filed: Jan. 26, 1998

[51] Int. Cl.[7] ..... H01H 35/34

[52] U.S. Cl. ..... 200/83 N; 200/83 S

[58] Field of Search ..... 200/83 S, 83 SA, 200/83 R, 83 N

[56] References Cited

U.S. PATENT DOCUMENTS

| | | | |
|---|---|---|---|
| 2,164,821 | 7/1939 | Katcher . | |
| 2,345,023 | 3/1944 | Yarbrough et al. | 200/83 S |
| 2,967,944 | 1/1961 | Lusted | 200/83 N |
| 3,862,387 | 1/1975 | Phillips et al. . | |
| 4,145,588 | 3/1979 | Orcutt | 200/83 N |
| 4,386,247 | 5/1983 | Couat | 200/83 N |
| 4,446,614 | 5/1984 | Haag | 200/83 SA |
| 4,636,598 | 1/1987 | Suzuki | 200/83 N |
| 4,820,890 | 4/1989 | Tamura et al. | 200/81.4 |
| 4,855,545 | 8/1989 | Kreuter | 200/81.4 |
| 4,892,985 | 1/1990 | Tateishi . | |
| 5,004,876 | 4/1991 | Sogge et al. | 200/83 P |
| 5,130,503 | 7/1992 | Heiress | 200/83 N |
| 5,140,742 | 8/1992 | Kaigler et al. | 29/622 |
| 5,216,213 | 6/1993 | Sato | 200/83 R |
| 5,421,242 | 6/1995 | Bächli et al. | 92/93 |

FOREIGN PATENT DOCUMENTS

| | | | |
|---|---|---|---|
| 0 169 280 | 1/1986 | European Pat. Off. . | |
| 0 375 224 | 6/1990 | European Pat. Off. . | |
| 2 262 392 | 9/1975 | France . | |
| 22408621 | 9/1974 | Germany | 200/83 N |
| 27 24 824 | 12/1978 | Germany . | |

*Primary Examiner*—Renee S. Luebke
*Attorney, Agent, or Firm*—Mark A. Garzia

[57] ABSTRACT

A low-cost, easy to manufacture and maintain pressure responsive switch. The switch includes a pressure responsive diaphragm made from latex rubber that is mounted in a housing base. An annular groove in the housing base communicates with an annular shoulder in a housing cover to compress an O-ring for forming upper and lower chambers, sealing the housing and securing the diaphragm.

2 Claims, 7 Drawing Sheets

PRESSURE RESPONSIVE SWITCH AND METHOD OF MAKING SAME

FIELD OF THE INVENTION

The present invention relates generally to a pressure responsive switch and, more specifically, to a low-cost pressure responsive switch that is reliable, and easy to manufacture and maintain.

BRIEF DESCRIPTION OF THE PRIOR ART

Pressure responsive switches are well-known in the art. Pressure responsive switches sense a change in pressure and respond to such changes by alternately making and breaking an electrical connection. (This is true for both "normally open" and "normally closed" switches; the difference being that an increase in pressure yields opposite results.)

In its most basic form, a pressure responsive switch comprises a diaphragm responsive to a pressure change, a rigid (i.e., usually metallic) ring for securing the diaphragm, and a pair of electrically conductive contacts (which are used to connect to a remote electrical circuit), that make- or break contact based on movement of the diaphragm. Relatively complex pressure switches have been used for specific applications (e.g., in automobile engines, refrigeration systems, industrial equipment, etc.). However, these complex pressure switches are designed for use in only one specific application and are relatively expensive to manufacture or modify for other applications.

There are a variety of relatively inexpensive pieces of equipment in which a pressure responsive switch would be a desirable addition but its expense makes it prohibitive to use. For example, for use with a flexible or bladder-type door edge on an overhead garage door controlled by an electric garage door opener. If the leading edge of the overhead door strikes an object as it travels downward, a pressure responsive switch can sense a change in pressure in the door edge and communicate to the electric door opener to reverse the direction of travel of the overhead door.

SUMMARY OF THE INVENTION

The present invention relates to a pressure responsive switch having a non-conductive (i.e., an electrically insulative) housing. The housing is preferably comprised of at least two pieces—a housing base and a housing cover. The housing base includes an open side for engagement with the housing cover. The open side of the housing base has an annular groove.

Two electrically conductive terminals, for connecting the switch to a remotely located electrical circuit, pass through the housing. An adjustable contact communicates with the housing for adjusting the sensitivity of the switch to pressure variations. The adjustable contact is electrically connected to one of the two electrically conductive terminals. A spring-tensioned contact assembly moves alternately into contact with and away from the adjustable contact, thereby forming a two-state (i.e., off/on) switch.

The housing includes an inlet aperture which provides means for applying a change in pressure within the housing. The change in pressure is generated by an external device and is used as the operative pressure that actuates the switch.

A pressure responsive member is disposed across at least the inner peripheral of the annular groove wherein at least a portion of the pressure responsive member deflects in response to a change in pressure within the housing. A flexible ring (e.g., a rubber O-ring) is positioned substantially over the periphery of the pressure responsive member, and is received by the annular groove. (Preferably, the pressure responsive member is circular in shape and is slightly larger than the inner diameter of the annular groove.)

The housing cover communicates with the O-ring and the annular groove for closing the open side of said housing base, and for securing the pressure responsive member in the annular groove. The O-ring and the annular groove work together to form an air-tight barrier between the housing base and the housing cover (creating an upper chamber and a lower chamber), and ultimately forming an air-tight seal between the base and the cover.

The spring-tensioned contact assembly comprises a flexible or movable portion. The contact assembly, disposed within said housing proximate the pressure responsive member and the adjustable contact, is electrically connected to the other of said two electrically conductive terminals. At least the flexible or movable portion of the spring-tensioned contact is positioned to be carried by the deflectable portion of the pressure responsive member into contact with said adjustable contact, thereby closing the switch (in a normally open switch embodiment) under action of the operative pressure. When the operative pressure is removed, the flexible portion springs back to its rest position, terminating its electrical connection with the adjustable contact.

The subject pressure responsive switch is easily and inexpensively manufactured. This feature makes it an ideal choice for use in relatively low-cost applications such as in an automatic garage door opener system. Also, minor changes in materials and/or dimensions affect the responsiveness and sensitivity of the subject switch. Another benefit is that many of the parts can be pre-manufactured and assembled at a later time. The subject switch is easily assembled and disassembled by hand which facilitates the ease in maintaining the switch.

BRIEF DESCRIPTION OF THE DRAWINGS

The accompanying drawings, which are incorporated in and form a part of the specification, illustrate the embodiments of the present invention and, together with the description, serve to explain the principles of the invention.

In the drawings.

DETAILED DESCRIPTION OF THE PREFERRED EMBODIMENT

Figure 1:
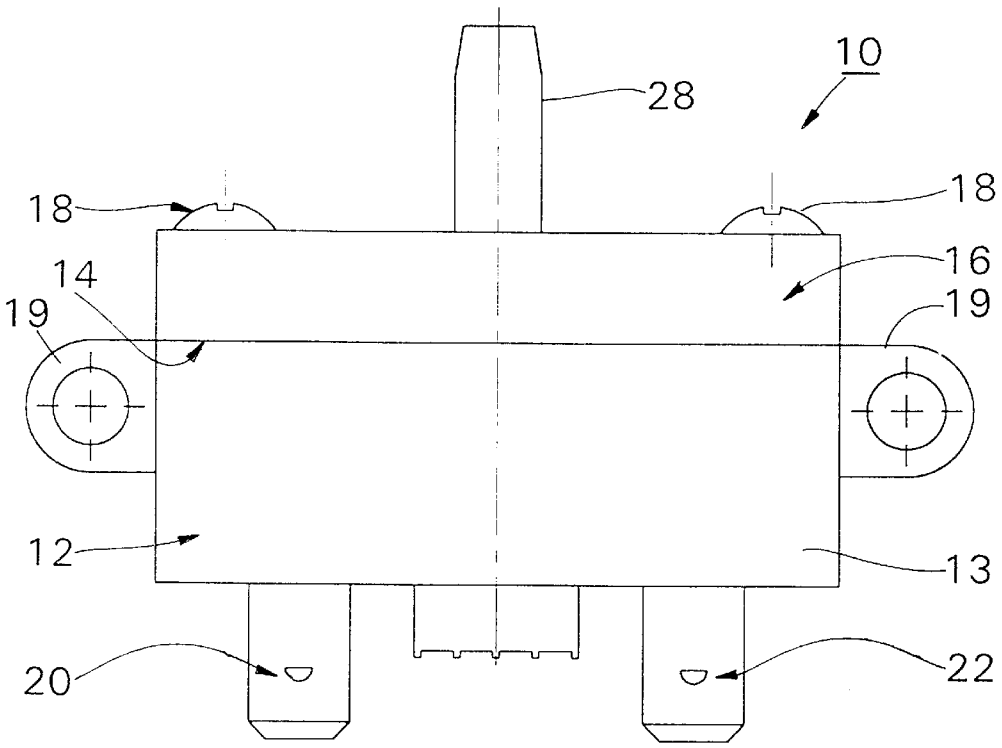
FIG. 1 is a side view of a pressure responsive switch in accordance with the present invention.
Figure 2:
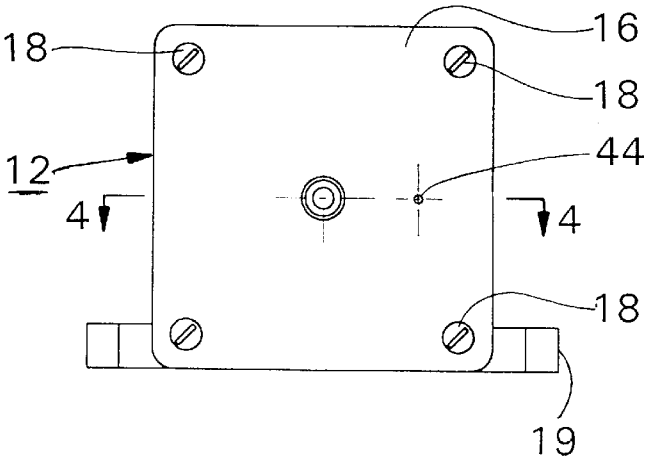
FIG. 2 is a top plan view of the pressure responsive switch shown in FIG. 1.

In describing a preferred embodiment of the invention, specific terminology will be selected for the sake of clarity. However, the invention is not intended to be limited to the specific terms so selected, and it is to be understood that each specific term includes all technical equivalents that operate in a similar manner to accomplish a similar purpose.

Preferred embodiments of the present invention will now be described in detail with reference to the accompanying drawings in which a pressure responsive switch is generally indicated at 10.

The principles and operation of the pressure responsive switch 10 are applicable to almost any type of fluid; however, the preferred fluid is air. Also, the switch preferably has two conditions, closed and open, and the switch is in its "normals" or resting condition at atmospheric pressure.

As shown in FIGS. 1 through 4, the switch 10 includes a housing 12 and a pair of electrically conductive terminals 20, 22 attached thereto. In order to facilitate the manufacture and assembly of the pressure responsive switch, the housing 12 is preferably comprised of a housing base 13 and a housing cover 16. The housing base 13 has an open side 14 that is designed for engagement with the housing cover 16. In addition, ears 19 may be added to the housing base 13 to provide a means for securing switch 10 to a flat surface of an external structure. The housing base 13 and housing cover 16 are made from an electrically insulative material. In a preferred embodiment, the housing base 13 and housing cover 16 are plastic and manufactured using an injection molding process.

The pair of terminals 20, 22 provide the means for connecting the switch 10 to a remotely located electrical circuit (e.g., the controller of an electric motor in an automatic garage door opener). The pressure responsive switch 10 described herein and generally illustrated in the drawings is normally open (i.e., no current flows between terminal 20 and terminal 22 in its at rest condition). An increase or positive change in the operative pressure closes switch 10 by making an electrical connection between terminal 20 and terminal 22.

In the preferred embodiment, a plurality of screws 18 are used to releasably attach the housing cover 16 to the housing base 13 by screwing them into pre-drilled holes 23. (See FIG. 8A.) Screws 18 may be of the self-tapping variety, or the screw holes 23 in the housing base 13 may be pre-tapped. The use of screws 18 provides an easy and convenient means for assembling the pressure responsive switch 10 and for opening the housing 12 in order to maintain and/or repair the pressure responsive switch 10.

Figure 4:
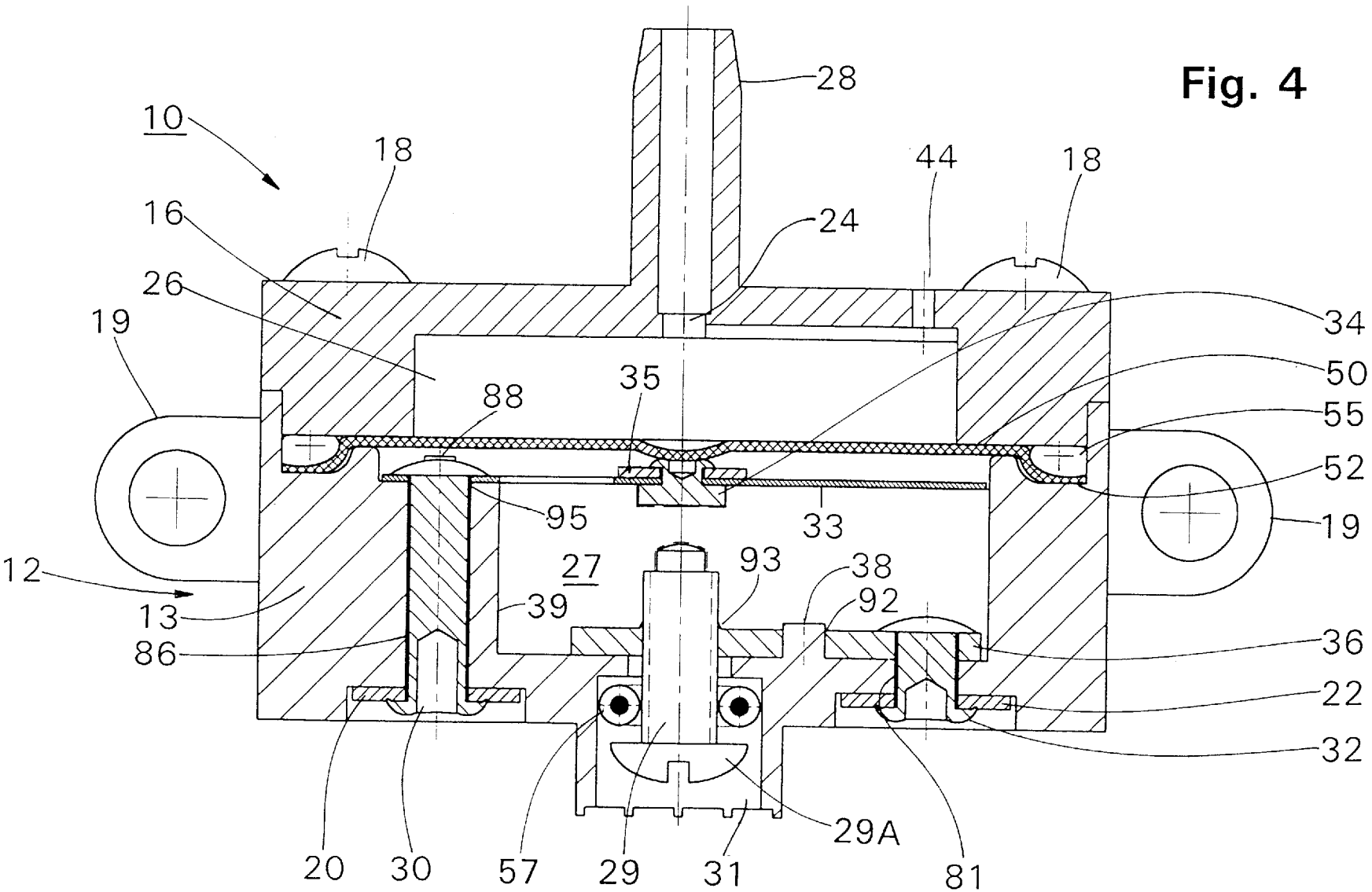
FIG. 4 is a sectional view of the pressure responsive switch shown in FIG. 1 taken along line 4—4.

As shown in FIG. 4, the housing 12 encloses two interior chambers, namely an upper chamber 26, located proximate the housing cover 16, and a lower chamber 27, located proximate the housing base 13. The two chambers 26, 27 are normally at atmospheric pressure. An inlet aperture 24 provides access to the upper chamber 26. The inlet aperture 24 provides a means for an external device (not shown) to communicate with the switch 10 via operative pressure changes in a fluid. (It is important to note that since the present design is intended to simplify the construction of a pressure responsive switch, the terminals 20, 22 and inlet aperture 24 may be placed in many different positions on the exterior surface of the housing depending on the internal configuration of the switch.)

In the preferred embodiment, the housing cover 16 is molded with a ram 28 for facilitating connection to a hose (not shown) which delivers the operating pressure (either positive or negative depending on whether the switch is normally open or normally closed) from the external device to the switch 10 through the inlet aperture 24. A change in pressure that is generated by the external device is detected by the pressure responsive switch 10 which in turn alters a condition in an electrical circuit (i.e., by making or breaking the electrical connection between terminal 20 and terminal 22). In other words, a mechanical action is converted into an electrical signal, usually in order to provide a response to the original mechanical action.

As illustrated in FIGS. 4 through 8B, a rivet 30 performs multiple tasks; it secures terminal 20 to the housing base 13; it passes through primary rivet aperture 86 and perimeter rivet aperture 95 thereby securing a spring-tensioned contact assembly 33 against abutment 39 proximate the open side 14; and it provides an electrically conductive path between terminal 20 and the spring-tensioned contact assembly 33. Similarly, a short or secondary rivet 32 secures terminal 22 to the housing base 13; passes through secondary rivet aperture 81 and first adapter aperture 91 for securing an adapter bar 36 to the housing base 13; and provides an electrically conductive path between terminal 22 and an adjustable contact via the adapter bar 36. The adjustable contact preferably comprises a silver-plated brass screw 29. Recesses 53, 54 are provided to prevent the bottom of rivets 30, 32, respectively, from protruding beyond the flat portion on the bottom of switch 10.

Note that screw head 29A can be positioned within a well 31 to prevent the accidental turning of screw contact 29. The well 31 communicates with a screw contact aperture 83 which allows screw 29 to pass through the housing base 13.

As shown in FIGS. 4 through 6B, the adapter bar 36 includes a first aperture 91 for accepting the short rivet 32, a second aperture 92 for accepting an alignment nub 38, and a third aperture 93 that allows the screw contact 29 to pass therethrough while continuously maintaining electrical contact with the screw contact 29.

The alignment nub 38 is used to assist in the alignment of the adapter bar 36 during the assembly of switch 10. Although the screw contact aperture 83 in the housing base 13 may be threaded, in the preferred embodiment the third aperture 93 of the adapter bar 36 is threaded to secure and for mating engagement with the silver-plated screw contact 29. The sensitivity of the switch 10 can be adjusted by inserting or withdrawing the screw contact 29 from lower chamber 27 by turning the head 29A of the screw contact 29. Other features that affect the sensitivity and operation of the pressure responsive switch 10 will be discussed in more detail below.

A small O-ring 57 may be used as a sealing washer to assist in preventing the escape of fluid from around screw contact 29. Also, small O-ring 57 "locks" (by frictional engagement) screw 29 in place so that the sensitivity of the switch 10 is not accidentally changed due to an undesired turning of screw 29. Finally, small O-ring 57 grabs the end of screw 29 during its initial insertion, thereby making the switch 10 easier to assemble.

Figure 7C:
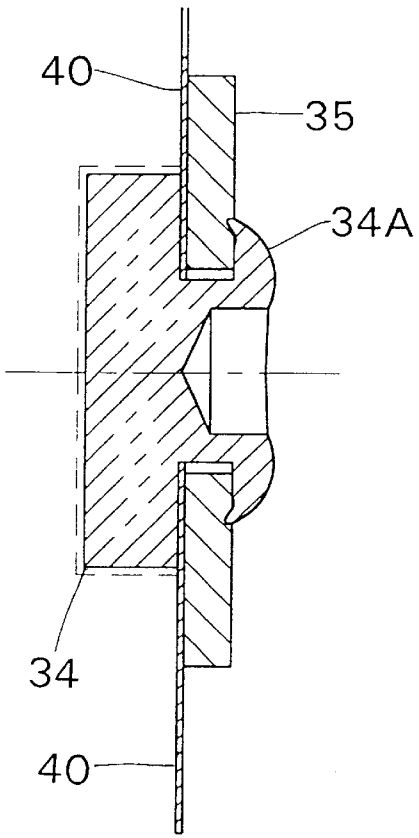
FIG. 7C is an enlarged sectional view of the contact shown in FIG. 7A taken along line 7—7.
Figure 7B:
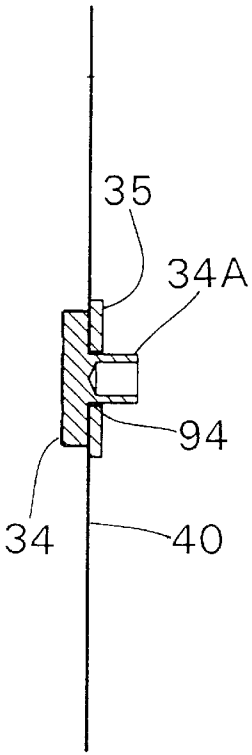
FIG. 7B is a side view of the contact and flexible arm during the assembly of the present switch.
Figure 7A:
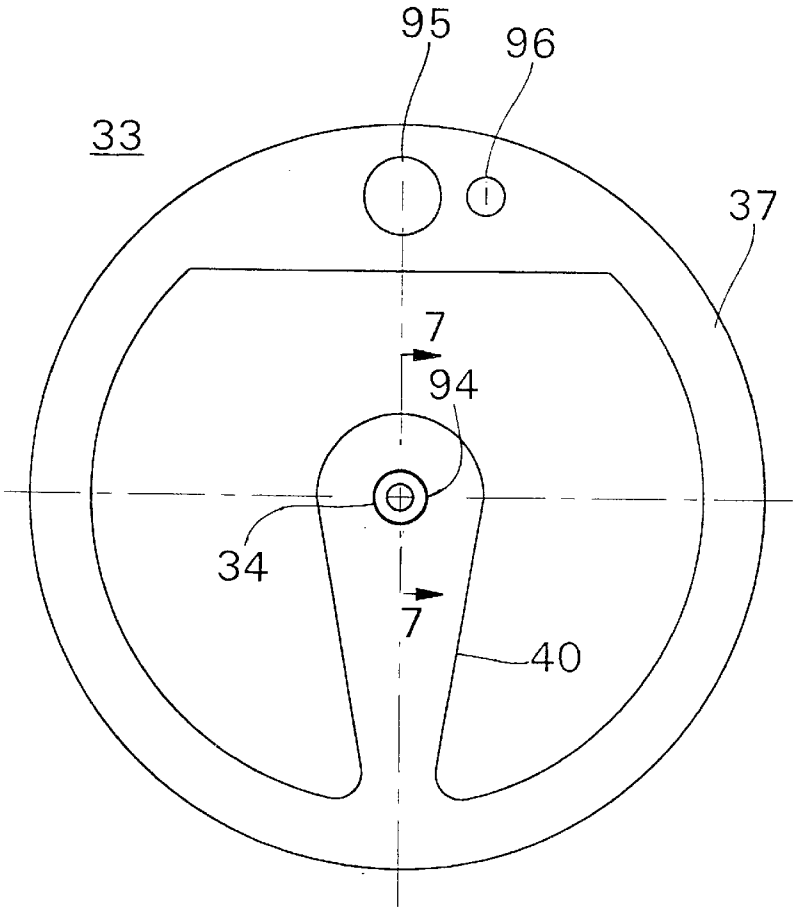
FIG. 7A is an enlarged plan view of the spring-tensioned contact assembly.

Referring now to FIGS. 7A through 7C, the spring contact assembly 33 is illustrated. The spring contact assembly 33 includes a contact element 34 having an annular connector 34A, a perimeter section 37 and a flexible arm 40. The perimeter 37 of the spring contact assembly 33 is generally circular in shape and includes a rivet aperture 95 and alignment aperture 96. The perimeter 37 is used to support the contact assembly 33 within the housing 12 proximate the open side 14 of the housing base 13 on abutment 39.

A contact alignment nub 88 is used to properly position contact assembly 33 during the assembly of the switch 10. The alignment aperture 96 is designed to receive nub 88. The rivet 30 is passed through perimeter rivet aperture 95 and primary rivet aperture 86 and affixes the contact assembly 33 to abutment 39.

A flexible arm 40 extends generally radially inward from the perimeter 37 of the spring contact assembly 33, substantially diametrically opposite to the rivet aperture 95. Note that the portion of the perimeter 37 proximate the flexible arm 40 "floats" within lower chamber 27 (i.e., it comes very close to the inner wall of housing base 13, but does not touch it).

The flexible arm 40 has a contact element aperture 94 substantially in the center of the spring contact assembly 33, for securing and positioning contact element 34. The perimeter 37 and the flexible arm 40 are preferably made of brass; the contact element 34 is preferably made of copper and plated with silver.

As shown in FIG. 7B, the annular connector 34A is passed through the contact element aperture 94 in the flexible arm 40 during assembly. As shown in FIG. 7C, the annular connector 34A is flared radially outward—similar to the operation of a rivet—in order to provide means to attach the contact 34 to the flexible arm 40, and to ultimately provide electrical conduction between the contact 34 and terminal 20. Since the spring contact assembly 33 (and, in particular, the flexible arm 40) is relatively thin, a washer 35 may be used to provide a more secure base to attach contact 34.

Referring again to FIG. 4, a pressure responsive member 50 is disposed proximate the spring contact assembly 33 forming a diaphragm. The pressure responsive member 50 is made of a durable, light-weight material that flexes with a change in operative pressure within housing 12 (i.e., a change in pressure in either upper chamber 26 or lower chamber 27). In its preferred embodiment, the pressure responsive member 50 is made of latex rubber.

Figure 5:
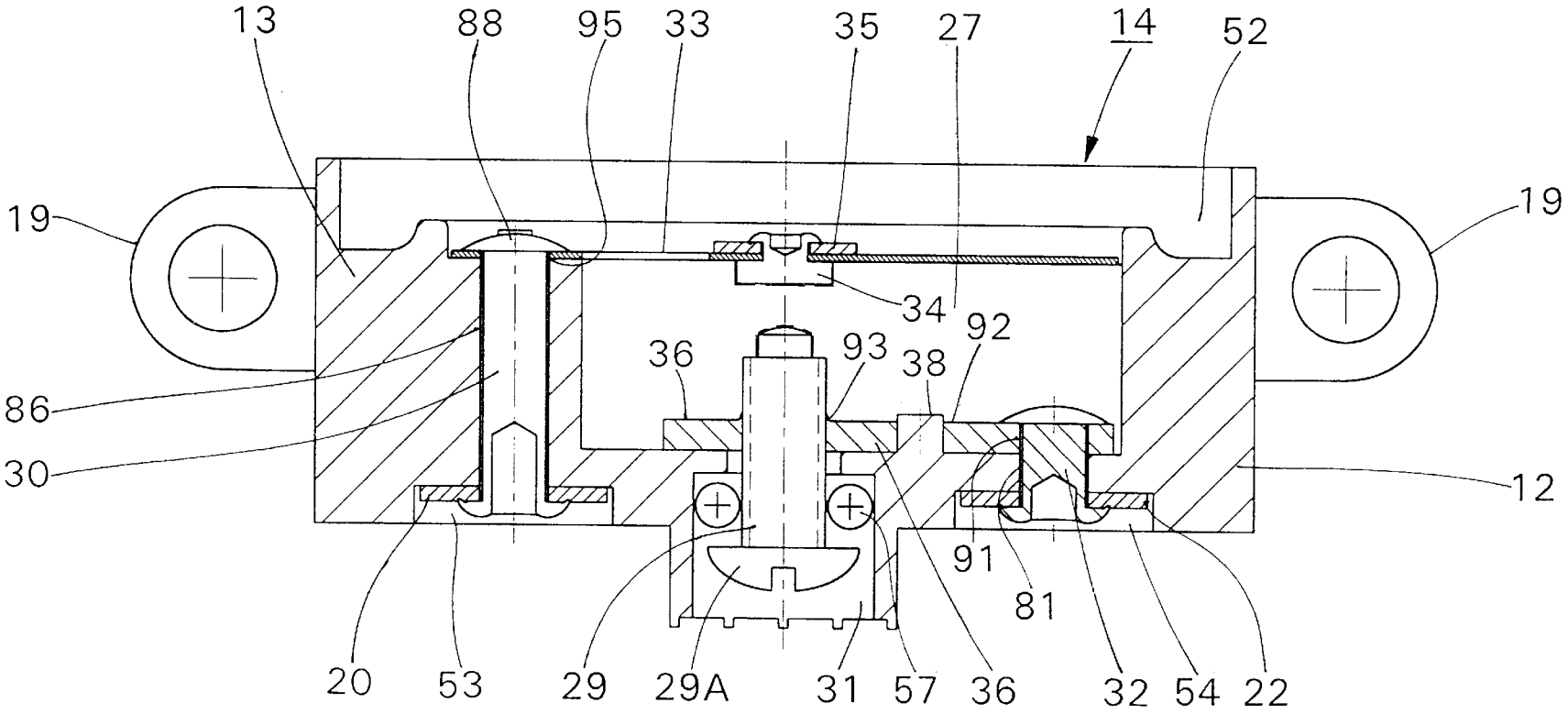
FIG. 5 is a sectional view of the housing of the pressure responsive switch shown in FIG. 1 taken along line 5—5 with the spring-tensioned contact assembly and the O-ring removed.
Figure 6A:
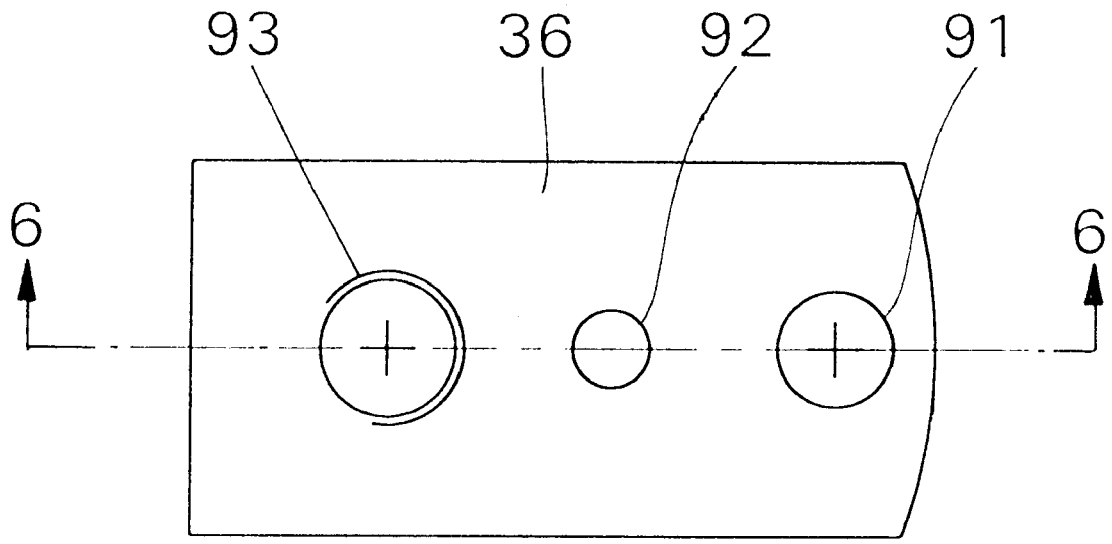
FIG. 6A is an enlarged top plan view of the adapter bar.
Figure 6B:
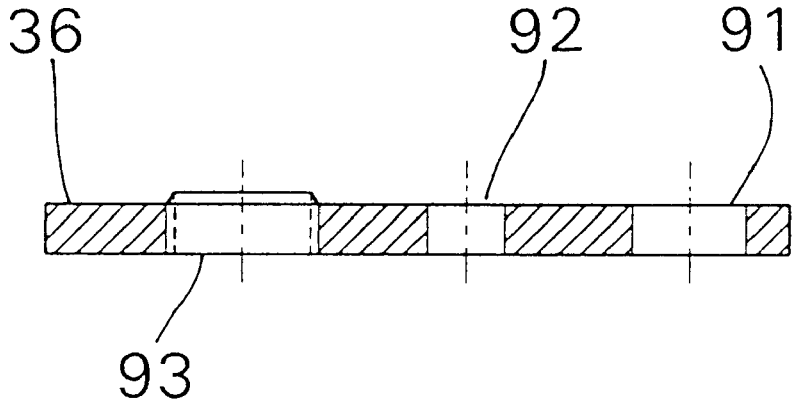
FIG. 6B is a sectional view of the adapter bar shown in FIG. 6A taken along line 6—6.
Figure 8B:
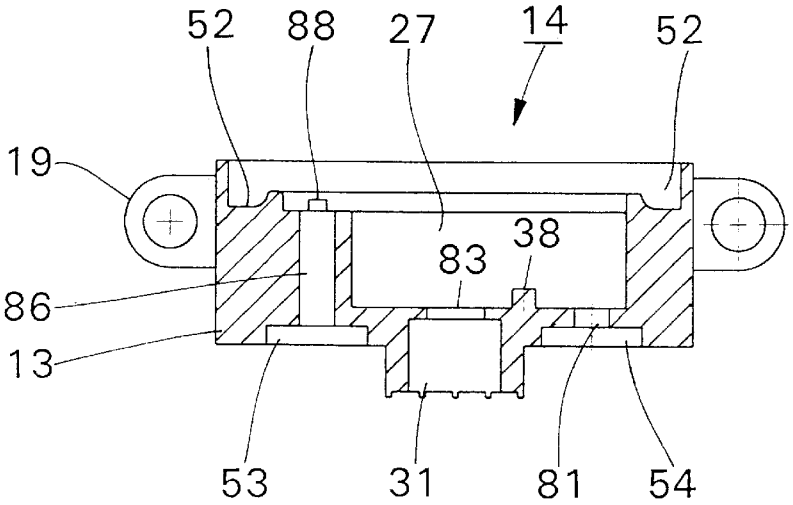
FIG. 8B is a sectional view of the housing base shown in FIG. 8A taken along line 8—8.
Figure 8A:
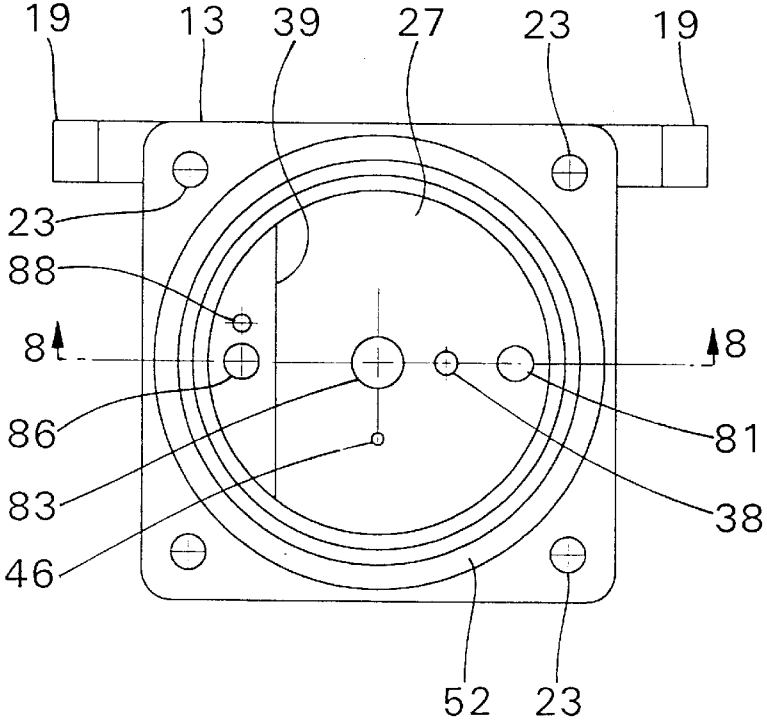
FIG. 8A is a top plan view of the housing base shown in FIG. 5 with the adapter bar, spring-tensioned contact assembly and screw contact removed.

Referring now to FIGS. 5, 8A and 8B, the housing base 13 has an annular groove 52, preferably having a diameter greater than the diameter of the spring contact assembly 33, as shown. A primary O-ring 55, having a diameter substantially equal to the diameter of the annular groove 52, is inserted over pressure responsive member 50 and seated in the annular groove 52. The primary O-ring 55 should be compressible and flexible and is preferably made of rubber.

The approximate center of the pressure responsive member 50 is preferably glued to contact 34. This increases the sensitivity of the switch and decreases the period of time for the switch 10 to change state (i.e., it becomes more responsive). Also, it ensures proper alignment when the pressure responsive member 50 engages the flexible arm 40.

Figure 9B:
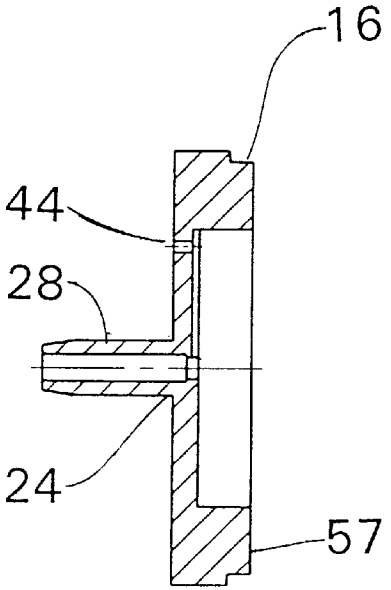
FIG. 9B is a sectional view of the housing cover shown in FIG. 9A taken along line 9—9.
Figure 9A:
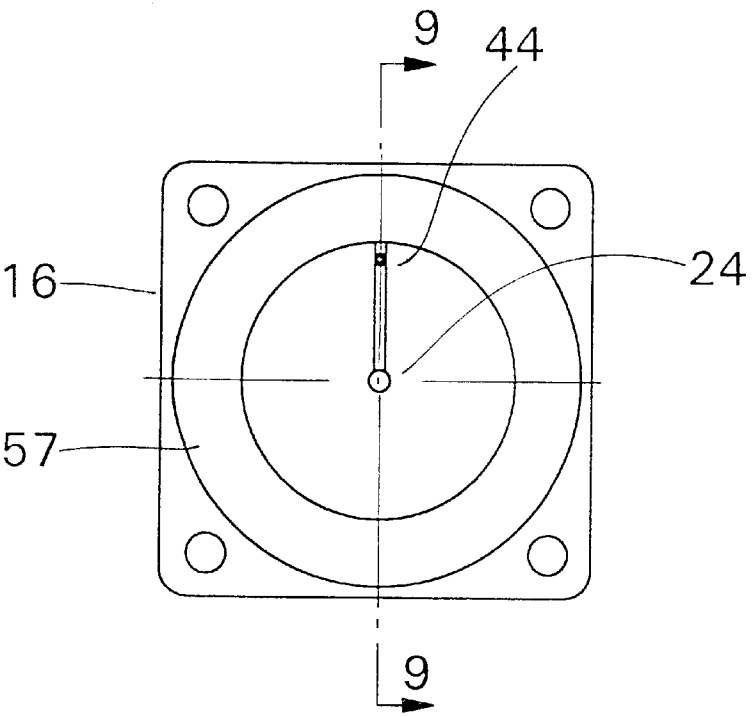
FIG. 9A is a bottom plan view of the housing cover.

As shown in FIGS. 9A and 9B, housing cover 16 preferably includes an annular shoulder 57 which projects from the bottom surface of the cover 16. The annular shoulder 57 engages and compresses the O-ring 55 when the housing cover 16 is secured against the housing base 13 by tightening the screws 18.

The annular groove 52, primary O-ring 55, housing base 13 and the housing cover 16 communicate with each other to secure the pressure responsive member 50, holding it in a preferably taut position; and to form a unitary, fluid-tight housing 12. As shown in FIG. 4, the compression of primary O-ring 55 plays an important role in the operation of switch 10. The O-ring 55 forms a fluid-impermeable seal around the perimeter of the pressure responsive member 50, effectively isolating upper chamber 26 from lower chamber 27; and it also forms a fluid-impermeable seal between the housing base 13 and housing cover 16 (which prevents the operative pressure from escaping between the housing members 13, 16).

Referring again to FIGS. 4, 9A and 9B, the housing cover 16 also includes a pressure release aperture 44 which provides a means for the fluid to escape from the upper chamber 26 after the switch has been actuated so that the switch 10 can reset itself after an initial operative pressure burst. The pressure release aperture 44 also allows excessive pressure to escape if an unusually large pressure is input into the switch 10, helping to reduce the possibility that the pressure responsive member 50 and/or the spring contact assembly 33 will be damaged.

Figure 3:
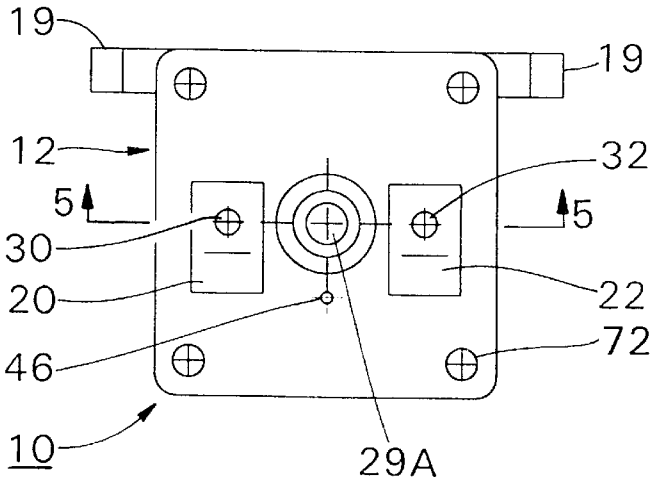
FIG. 3 is a bottom plan view of the pressure responsive switch shown in FIG. 1.

A similar pressure release aperture 46, as seen in FIGS. 3 and 8A, is found on the housing base 13. Aperture 46 communicates with lower chamber 27 and provides an outlet for the release of air when the pressure responsive member 50 moves and temporarily reduces the volume of lower chamber 27. Both pressure release apertures 44, 46 are smaller in diameter than the inlet aperture 24. The diameter and the location of the pressure release apertures 44, 46 affects the sensitivity of the switch 10 and can be adjusted to accommodate a specific purpose or switch design.

The sensitivity of the switch 10 (i.e., the level of pressure needed to activate the switch 10) can be manually adjusted by turning the head 29A of the screw contact 29. As the screw contact 29 is inserted into the housing 12 (or, more specifically, into the lower chamber 27) the distance between contact 34 and screw contact 29 decreases thereby making the switch 10 more sensitive to pressure changes within the upper chamber 26. As the screw contact 29 is withdrawn from the housing 12, the distance between contact 34 and screw contact 29 increases thereby making the switch 10 less sensitive to pressure changes in upper chamber 26.

An important feature of the present invention is the ability to refine the sensitivity of the switch 10 by changing the material of certain elements or changing specific dimensions. For example, the type of material and thickness of spring contact assembly 33; the type of material and thickness of pressure responsive member 50; and the diameter of apertures 24, 44, and 46 all affect the sensitivity of the switch 10. It should be noted that the free or floating portion of perimeter 37 not only reduces wear and tear on the pressure responsive member 50, but also increases the switch's sensitivity. Other factors control the responsiveness (i.e., the period of time it takes to actuate the switch after the application of the appropriate level of the operative pressure). For example, changes in either the volume of upper chamber 26 or lower chamber 27; and the fusing of the approximate center of the pressure responsive member 50 to contact 34 makes the switch more responsive. Also, the tautness or tension of the pressure responsive member 50 across the annular groove 52 affects the overall responsiveness of the switch 10.

Referring again to FIGS. 1 through 4, the operation of the switch will now be discussed in more detail. A hose or tube (not shown) is connected to ram 28. The hose originates at an external device that generates a pressure differential in a fluid. In this embodiment, the switch 10 requires an increase in fluid pressure to actuate or change the state of the switch from its 'normal'or resting state. The pressure increase delivered via the hose becomes the operative pressure which eventually actuates switch 10.

In its resting position, the pressure responsive member 50 is substantially flat and parallel to spring contact assembly 33. The hose delivers the operative pressure from the external device, which is then directed by ram 28 and inlet aperture 24 into upper chamber 26. As the operative pressure inside upper chamber 26 increases, the pressure responsive member 50 is "pushed" towards contact 34, and eventually engages the contact 34. (Note that if the pressure responsive member 50 is glued/fused to contact 34, the response time of the switch is improved.)

As the pressure increases, pressure responsive member 50 moves contact 34—since it is positioned approximately at the end of flexible arm 40—into physical contact with screw contact 29, thereby making electrical connection between terminal 20 and terminal 22 (i.e., closing switch 10). As the pressure responsive member 50 moves contact 34, the volume of lower chamber 27 decreases, however, the pressure remains the same since any excess pressure within lower chamber 27 is released by aperture 46, equalizing the pressure in lower chamber 27 with the pressure exterior to housing 12. Although the pressure in upper chamber 26 increases, aperture 44 helps to prevent damage to the switch by venting the excess pressure.

After the external device ceases generation of the pressure differential, the operative pressure is released through aperture 44. This causes pressure responsive member 50 to return to its normal or resting position, physical movement of contact 34 away from screw contact 29 which opens switch 10 (i.e., breaking the electrical connection between terminal 20 and terminal 22), thereby effectively re-setting switch 10.

If the external device regularly delivers a continuous operative pressure (in contrast with a plurality of bursts), then the diameter of apertures 44, and 46 should be designed to take this condition into account. Accordingly, the continuous fluid pressure stream delivered to upper chamber 26 is released through aperture 44; similarly, the continuous pressure build-up in chamber 27 will be released by aperture 46. This reduces the possibility that the switch, and in particular the pressure responsive member 50, will be damaged during normal operation of the switch.

The distance between screw contact 29 and contact 34 can be manually adjusted by turning the head of screw contact 29, thereby adjusting the sensitivity of the switch 10. As screw contact 29 is withdrawn, increasing the distance between screw contact 29 and contact 34, a greater operative pressure is required within upper chamber 26 to close switch 10. As screw contact 29 is inserted, decreasing the distance between screw contact 29 and contact 34, a lower operative pressure is required within upper chamber 26 to close switch 10.

The switch 10 illustrated in FIGS. 1 through 4 is a normally open switch which is closed by an increase in the operative pressure. After reading the present specification, one skilled in the art would appreciate that a normally open switch can be actuated with negative pressure (i.e., a vacuum), by moving inlet aperture 24 (and ram 28) to the housing base 13. In this new embodiment, the operative pressure would have to decrease fluid pressure within lower chamber 27 which would draw the pressure responsive member 50 and contact 34 towards screw contact 29 until physical contact between contact 34 and screw contact 29 is made, thereby closing the switch.

Similarly, "normally closed" switches can also be manufactured with minor variations in the illustrated embodiment. In a normally closed switch, contact 34 and screw contact 29 would be in physical contact with each other when the pressure responsive member 50 is in its normal or resting position, thereby making an electrical connection between terminal 20 and terminal 22. Depending on the housing design (specifically, the location of inlet aperture 24), the operative pressure (either positive or negative) would still actuate switch 10, but it is used to open the switch. The operative pressure would act on pressure responsive member 50 so that it carries contact 34 away from screw contact 29, thereby breaking the electrical connection between terminal 20 and terminal 22.

The manufacture and assembly of the pressure responsive switch 10 will now be discussed in connection with FIGS. 4 through 9B. All parts of the switch may be pre-manufactured and are designed for easy assembly by hand. The housing base 13 and the housing cover 16 are preferably made from polymer plastic in an injection molded process. Well 31, ram 28 and alignment nubs 38 and 88 are formed during the molding process. Apertures 24, 44, 46, 81, 83 and 86 can be formed by the mold or drilled out. Terminals 20, 22, and adapter bar 36 are cut or punched from copper or brass pieces. In addition, adapter bar 36 is drilled or punched to form first, second and third apertures 91, 92, 93. Third aperture 93 is also tapped so that screw contact 29 can be screwed therein.

Spring contact assembly 33 is cut or fabricated from conductive material (e.g., copper, brass or brass alloys), as is contact 34. Rivet aperture 95 and alignment aperture 96 are drilled or punched into the periphery 37 opposite the side on which the flexible arm protrudes. If desired, contact 34 and screw contact 29 are plated with silver. Contact 34 is secured to flexible arm 40 by flaring annular connector 34A.

The adapter bar 36 is placed over alignment nub 38; terminal 22 is placed in recess 54. Rivet 32 is passed through aperture 81 and secures terminal 22 and adapter bar 36 to the housing base 13. Next, the spring contact assembly 33 is placed above abutment 39 and over alignment nub 88; terminal 20 is placed in its position within recess 53. Rivet 30 is used to secure terminal 20 and spring contact assembly 33 to the housing base 13. The screw contact 29 is inserted through the small O-ring 57 and then screwed into the adapter bar 36.

The pressure responsive member 50 is preferably pre-cut from a sheet of latex rubber. The preferred shape of the pressure responsive member 50 is circular so that it covers the annular groove 52 in the housing base 13. The pressure responsive member 50 is glued to contact 34, and its periphery is inserted in the annular groove 52. During assembly, the glue does not necessarily have to dry before proceeding with the final steps in the assembly process.

The primary O-ring 55 is placed over the pressure responsive member 50 and seated into the annular groove 52. The housing cover 16 is aligned over the O-ring. Finally, screws 18 are screwed into the housing base 13 forcing the shoulder 59 to engage and compress the O-ring 55, thereby securing the pressure responsive member 50 and forming an air-tight seal between the housing base 13 and the housing cover 16.

Although this invention has been described and illustrated by reference to specific embodiments, it will be apparent to those skilled in the art that various changes and modifications may be made which clearly fall within the scope of this invention. The present invention is intended to be protected broadly within the spirit and scope of the appended claims.

We claim:

1. A pressure responsive switch comprising:

a) a housing base with an open side;

b a housing cover that communicates with the open side of the housing base to form a fluid-tight housing;

c) first and second electrically-conductive terminals passing through said housing;

d) an adjustable contact for adjusting the sensitivity of the switch, the adjustable contact being electrically connected to said first terminal;

e) a pressure responsive member disposed within the housing, the pressure responsive member communicating with the housing to define first and second chambers wherein at least a portion of said pressure responsive member is deflectable in response to a change in pressure within either of said chambers;

f) means that communicate with said housing for applying an operative pressure within at least one of said chambers; and g) a spring-contact assembly disposed within said housing and electrically connected to the second electrically-conductive terminal, said spring-contact assembly being positioned to have at least a portion of the spring-contact assembly be carried by the deflectable portion of the pressure responsive member into contact with said adjustable contact during said change in pressure within one of said chambers, thereby making an electrical connection between the first terminal and the second terminal wherein said spring-contact assembly comprises an elongated flexible member that extends radially inwards from an annular metallic member, said annular metallic member being secured to said housing.

2. The switch of claim 1 wherein said carried portion of the spring-contact assembly is fused to the deflectable portion of the pressure responsive member.

* * * * *